US012782074B2

(12) United States Patent
Farley, Jr. et al.

(10) Patent No.: US 12,782,074 B2
(45) Date of Patent: Nov. 3, 2026

(54) BALL AND BLADE TRIGGER MECHANISM

(71) Applicants: James Shelton Farley, Jr., Oklahoma City, OK (US); James Shelton Farley, III, Oklahoma City, OK (US); Michael Alan Farley, Edmond, OK (US)

(72) Inventors: James Shelton Farley, Jr., Oklahoma City, OK (US); James Shelton Farley, III, Oklahoma City, OK (US); Michael Alan Farley, Edmond, OK (US)

( * ) Notice: Subject to any disclaimer, the term of this patent is extended or adjusted under 35 U.S.C. 154(b) by 0 days.

(21) Appl. No.: 19/037,741

(22) Filed: Jan. 27, 2025

(65) Prior Publication Data

US 2025/0172364 A1 May 29, 2025

Related U.S. Application Data

(63) Continuation-in-part of application No. 18/093,639, filed on Jan. 5, 2023, now Pat. No. 12,209,833.

(60) Provisional application No. 63/361,555, filed on Jan. 5, 2022.

(51) Int. Cl.
*F41A 19/48* (2006.01)
*F41A 19/44* (2006.01)

(52) U.S. Cl.
CPC ..... *F41A 19/48* (2013.01); *F41A 19/44* (2013.01)

(58) Field of Classification Search
CPC ..... F41A 19/48; F41A 19/44; F41A 19/18; F41A 19/35
See application file for complete search history.

(56) References Cited

U.S. PATENT DOCUMENTS

| | | | | |
|---|---|---|---|---|
| 325,053 | A | 8/1885 | Chuchu | |
| 571,260 | A | 11/1896 | Borchardt | |
| 811,807 | A | 2/1906 | Wesson | |
| 2,116,140 | A * | 5/1938 | Browning | F41A 19/30 89/130 |
| 2,352,191 | A | 6/1944 | Garand | |
| 2,367,280 | A | 1/1945 | Hyde | |
| 2,448,810 | A | 9/1948 | Koucky et al. | |
| 2,464,427 | A | 3/1949 | Wilson | |
| 2,711,042 | A | 6/1955 | Simmons | |
| 2,742,822 | A | 4/1956 | Harvey | |
| 2,804,709 | A | 9/1957 | Hughel et al. | |
| 2,909,100 | A | 10/1959 | Kennerley-Tayler | |
| 3,158,948 | A | 12/1964 | Freed | |
| 3,193,960 | A | 7/1965 | Stevens, Jr. | |
| 3,306,167 | A | 2/1967 | Ramseyer | |

(Continued)

FOREIGN PATENT DOCUMENTS

GB 2172974 10/1986

OTHER PUBLICATIONS

Pike, Travis; "Best of Pocket Pistols [2022]", retrieved from https://gununiversity.com on Dec. 28, 2022.

(Continued)

*Primary Examiner* — J. Woodrow Eldred
(74) *Attorney, Agent, or Firm* — Robert H. Frantz

(57) ABSTRACT

A hammerset device for a firearm incorporates a single quadrant, fixed point, modified Scotch Yoke mechanism between a trigger finger piece and a hammer such that linear movement of the trigger finger piece translates to releasing the hammer, and optionally, continued linear movement of the trigger cocks the hammer for a subsequent firing of the firearm.

18 Claims, 12 Drawing Sheets

(56) References Cited

U.S. PATENT DOCUMENTS

| | | | | |
|---|---|---|---|---|
| 3,352,046 | A | 11/1967 | Warner et al. | |
| 3,605,312 | A | 9/1971 | Domian | |
| 3,797,154 | A | 3/1974 | Seecamp | |
| 3,965,604 | A * | 6/1976 | Khaidurov | F41A 19/44 42/69.03 |
| 4,067,131 | A | 1/1978 | Ruger et al. | |
| 4,121,497 | A | 10/1978 | Gantia | |
| 4,208,947 | A | 6/1980 | Hillberg | |
| 4,391,057 | A | 7/1983 | Bornancini | |
| 4,416,087 | A | 11/1983 | Hillberg | |
| 4,489,515 | A | 12/1984 | Numbers | |
| 4,625,443 | A | 12/1986 | Beretta | |
| 4,722,148 | A | 2/1988 | Walker | |
| 4,854,065 | A | 8/1989 | French et al. | |
| 4,876,943 | A | 10/1989 | Bilger et al. | |
| 5,421,114 | A | 6/1995 | Bond et al. | |
| 5,517,897 | A | 5/1996 | Perrine | |
| 5,615,507 | A | 4/1997 | French | |
| 5,680,722 | A | 10/1997 | French et al. | |
| 6,347,474 | B1 | 2/2002 | Wolff, Jr. | |
| 7,469,623 | B1 | 12/2008 | Olcott | |
| D686,685 | S | 7/2013 | Kohout | |
| 8,495,831 | B1 | 7/2013 | Kohout | |
| 8,887,429 | B2 | 11/2014 | Zajk | |
| 8,915,003 | B2 | 12/2014 | Heizer et al. | |
| 8,950,311 | B2 | 2/2015 | Emde et al. | |
| 9,062,929 | B2 | 6/2015 | Kohout | |
| 11,754,359 | B2 | 9/2023 | Moore | |
| 2013/0199070 | A1 | 8/2013 | Heizer et al. | |
| 2013/0205632 | A1 | 8/2013 | Kohout | |
| 2015/0253097 | A1 | 9/2015 | Kohout | |
| 2016/0282074 | A1 | 9/2016 | Kohout | |
| 2017/0299324 | A1 | 10/2017 | Patel | |
| 2023/0235982 | A1 | 7/2023 | Muska | |
| 2023/0408221 | A1 | 12/2023 | Frankel | |

OTHER PUBLICATIONS

Wikipedia; "Derringer"; rerieved on Dec. 28, 2022 from https://en.wikipedia.org.

Wikipedia; "Pepperbox"; rerieved on Dec. 28, 2022 from https://en.wikipedia.org.

Wikipedia; "Pocket Piston"; rerieved on Dec. 28, 2022 from https://en.wikipedia.org.

USPTO; first Office Action notified on Jun. 7, 2024 in related U.S. Appl. No. 18/093,639 filed Jan. 5, 2023.

Farley, et al.; Applicant's reply to first Office Action submitted on Sep. 9, 2024 in related U.S. Appl. No. 18/093,639, filed Jan. 5, 2023.

USPTO; Corrected Notice of Allowance and Issue Fee Due notified on Sep. 25, 2024 in related U.S. Appl. No. 18/093,639, filed Jan. 5, 2023.

USPTO; Notice of Allowance and Issue Fee Due notified on Dec. 17, 2024 in related U.S. Appl. No. 18/093,639, filed Jan. 5, 2023.

Farley, et al.; Replacement drawings submitted on Nov. 14, 2024 in related U.S. Appl. No. 18/093,639 filed Jan. 5, 2023.

Basutkar, Kedar; "Kinematic Comparison of scotch Yoke with Single Slider Crank Mechanism"; published by Medium.com online on Jan. 28, 2022.

Doubletap Defense LLC; "Tacktical Pocket Pistol", retrieved from http://www.doubletapdefense.com on Dec. 18, 2024.

* cited by examiner

*Prior Art*

800

BALL AND BLADE TRIGGER MECHANISM

BENEFIT CLAIM TO FILING DATE FOR EARLIER-FILED PATENT APPLICATION

This non-provisional patent application claims benefit of the filing date of U.S. Non-provisional patent application Ser. No. 18/093,639 which was filed on Jan. 5, 2023, by James Shelton Farley, Jr., et al., which claimed benefit of the filing date of Provisional Patent Application 63/361,555, filed on Jan. 5, 2022, by James Shelton Farley, Jr., et al.

INCORPORATION BY REFERENCE

U.S. Non-provisional patent application Ser. No. 18/093,639 which was filed on Jan. 5, 2023, by James Shelton Farley, Jr., et al., and U.S. Provisional Patent Application 63/361,555, filed on Jan. 5, 2022, by James Shelton Farley, Jr., et al., are hereby incorporated by reference in their entireties, including figures.

FIELD OF THE INVENTION

This non-provisional patent application claims benefit of the filing date of U.S. Non-provisional patent application Ser. No. 18/093,639 which was filed on Jan. 5, 2023, by James Shelton Farley, Jr., et al., which claimed benefit of the filing date of Provisional Patent Application 63/361,555, filed on Jan. 5, 2022, by James Shelton Farley, Jr., et al. The present invention relates to certain improvements of firearms, and particularly to compact pistols.

BACKGROUND OF THE INVENTION

Compact pistols include pistols which are designed to be stored in small areas. Pocket pistols are a type of compact pistol which are designed to be small enough, lightweight enough and safe for carrying in a pocket such as a pant pocket or a jacket pocket. Most pocket pistols have a capacity of one to seven rounds, weigh less than 22 ounces, and are smaller than 6.5 inches long by 5 inches high, but some are much smaller and some are larger. Pocket pistols fulfill many roles in personal defense, including but not limited to deep concealment (personal defense, undercover law enforcement, etc.), backup gun (law enforcement, military, etc.), and convenience carry (personal defense).

SUMMARY OF THE EXEMPLARY EMBODIMENTS OF THE INVENTION

A hammerset device for a firearm incorporates a single quadrant, fixed point, modified Scotch Yoke mechanism between a trigger finger piece and a hammer such that linear movement of the trigger finger piece translates to releasing the hammer, and optionally, continued linear movement of the trigger cocks the hammer for a subsequent firing of the firearm.

BRIEF DESCRIPTION OF THE DRAWINGS

The following figures, when considered in conjunction with the rest of the present disclosure, provide one or more exemplary embodiments of the present invention, including certain improvements.

DETAILED DESCRIPTION OF ONE OR MORE EXEMPLARY EMBODIMENT(S) OF THE INVENTION

Figure 1:
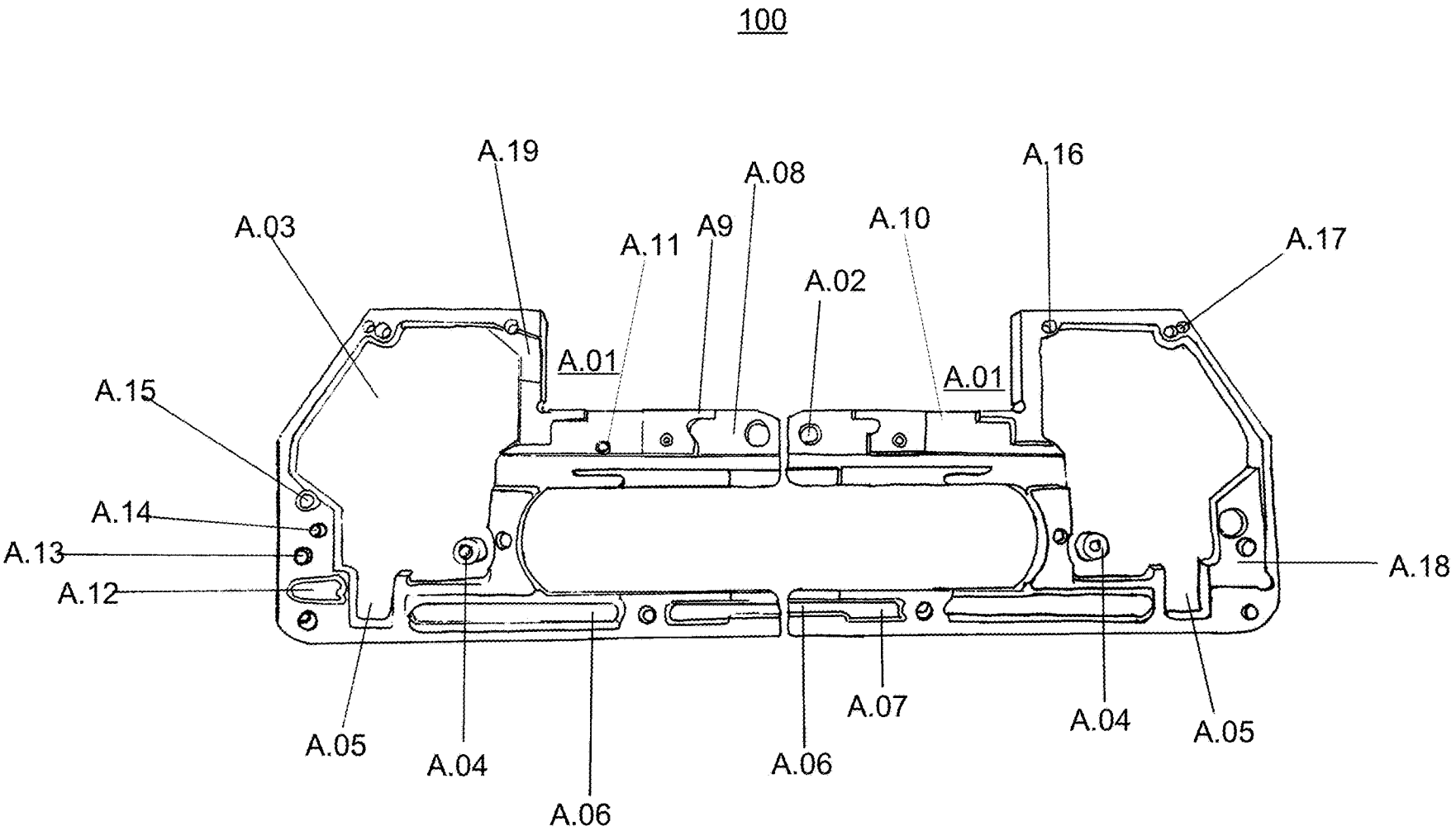
FIG. 1 provides a illustration of an open view of both halves of a pistol frame according to at least one embodiment of the related invention.

The present inventor(s) have recognized that certain needs of users and carriers of small and very small firearms remain unmet. The pistol design described in the related patent application addressed and solved many of these needs for a pocket pistol for concealed carry on one's person Further, to enable such a flat or thin pistol design, the present inventors devised a new type of trigger mechanism which can be use in other types of firearms as well.

For the purposes of illustration of the new, flatter and thinner trigger mechanism, this disclosure will describe its use with the related compact pistol. Those having ordinary skill in the art will recognize, however, that this new trigger mechanism can be used in a variety of other types of firearms and trigger-controlled weapons. We will begin by describing the pistol of the related invention.

The New, Flatter and Thinner Dual-Trigger Pistol of the Related Invention

Pocket pistols have been desired for personal defense for hundreds of years. The very early designs employed ball and cap ammunition of the time. Advancements in ammunition and manufacturing methods have yielded a variety of double action multi-barreled designs, commonly referred to as Derringer pistols, and archaically referred to as pepper-box pistols.

Perhaps a brief description of double action as it pertains to this instance is useful. Double action for purpose herein references the actions of cocking the pistol to fire and cartridge advancement in the same trigger pull. Specifically in this case, a pistol with fixed barrels, cocking the pistol to fire and barrel selection in the same trigger pull.

Within the last 125 years, two types of double action multi-barreled pistols have become the standard. In both designs an embodiment of a basic ratchet and pawl is employed to mechanically generate barrel selection. Considering two barreled pistols, the indexing ratchet is configured in a radial arrangement. Four-barreled pistol designs position the ratchet in an axial configuration.

The embodiments of the related present invention include a new design of a double action multi-barreled pistol using a radially configured ratchet and a unique double action hammer. The main objectives according to at least one embodiment of the related invention were, firstly concealability, as it relates to pistol size, thickness, and weight. Many pocket pistols can be heavy or otherwise viewable in the pocket. Secondly, the pistol should be able to be brought into service quickly, which translates to a pistol design without an external hammer or the use of a muzzle sight. Some known designs with these features can be slow to be brought to bear when drawing down, which the present invention intends to improve. Thirdly, reliability in operation is a must, which translates into mechanical simplicity. The compact nature of known double action pocket pistols often results in design complexities, which affect reliability negativity.

Turning to the figures according to at least one embodiment of the related invention, its components, the pistol frame and interworking components may be viewed. The external shape according to at least one embodiment of the present invention is generally rectangular, like a deck of playing cards, wallet or cell phone, such that it "prints" (e.g., produces a shape on the outside of a cloth garment when carried in a pocket) with a shape other than that resembling a traditional L-shape of a pistol. This enhances its concealability.

Referring now to FIG. 1, an open view 100 is shown of both halves which comprise the Pistols' Frame according to at least one embodiment of the present invention such that integral features of the frame may be viewed and considered. Table 1 sets forth reference designators corresponding to frame elements and components, whether separately provided or integrally formed into one half or both halves of the frame:

TABLE 1

Frame Components and Elements

| Reference Designator | Component or Element |
|---|---|
| A.01 | Barrel Relief |
| A.02 | Barrel Attachment |
| A.03 | Hammerset Relief |
| A.04 | Hammerset Pivot Boss |
| A.05 | Main Spring Cavity |
| A.06 | Trigger Raceway Slot |
| A.07 | Spring Containment Pocket |
| A.08 | Barrel Pivot Relief |
| A.09 | Barrel Pivot Stop Engagement |
| A.10 | Barrel Latch Relief |
| A.11 | Barrel Trigger Stop Boss |
| A.12 | Pawl Spring Slot |
| A.13 | Pawl Limit Pin |
| A.14 | Pawl Attachment Hole |
| A.15 | Pawl Pivot Boss |
| A.16 | Frame Attachment Holes |
| A.17 | Frame Alignment Holes |
| A.18 | Pawl Relief |
| A.19 | Firing Pin Relief |

Figure 2:
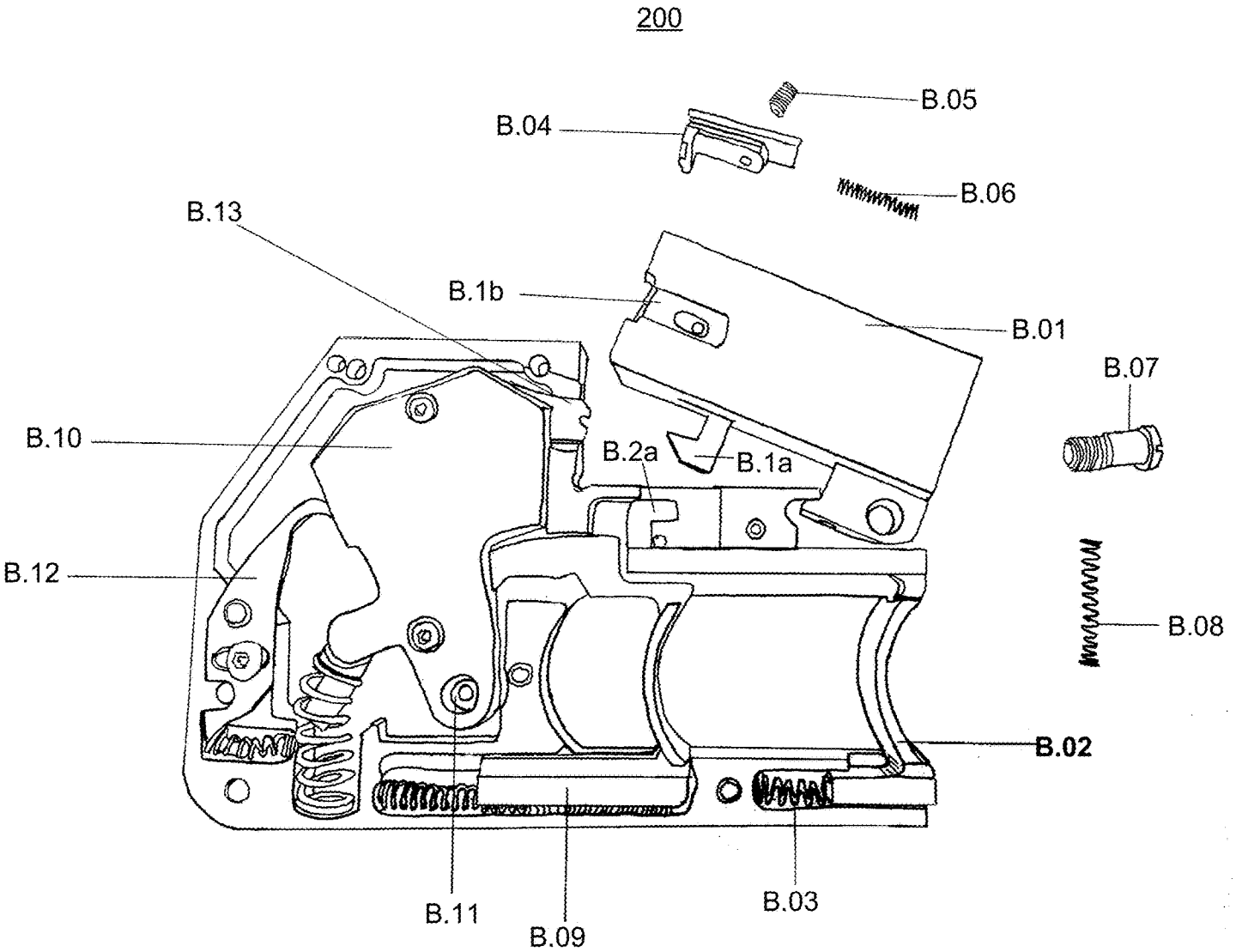
FIG. 2 provides a illustration according to at least one embodiment of the related invention with a semi-assembled view of the pistol's left side frame.

Referring to FIG. 2 shows 200 a semi-assembled view of the pistol using the left side frame according to at least one embodiment of the related invention. The reader may notice a macro view of the pistol in order to get a general view of the components and their relationships with each other. Table 2 sets forth reference designators corresponding to elements and components, whether separately provided or integrally formed into the left half the frame:

TABLE 2

Components and Elements of Semi-Assembled Left Side of Frame

| Reference Designator | Component or Element |
|---|---|
| B.01 | Barrel Set |
| B.02 | Barrel Trigger |
| B.03 | Barrel Trigger Spring |
| B.04 | Extractor |
| B.05 | Extractor Set Screw |
| B.06 | Extractor Spring |
| B.07 | Barrel Attachment Screw |
| B.08 | Barrel Tilt Spring |
| B.09 | Firing Trigger |
| B.10 | Hammerset |
| B.11 | Hammerset Pivot Boss |
| B.12 | Pawl |
| B.13 | Firing Pin |
| B.1a | Barrel Lock Projection |
| B.1b | Extractor Slot |
| B.2a | Barrel Trigger Lock Projection |

Figure 3:
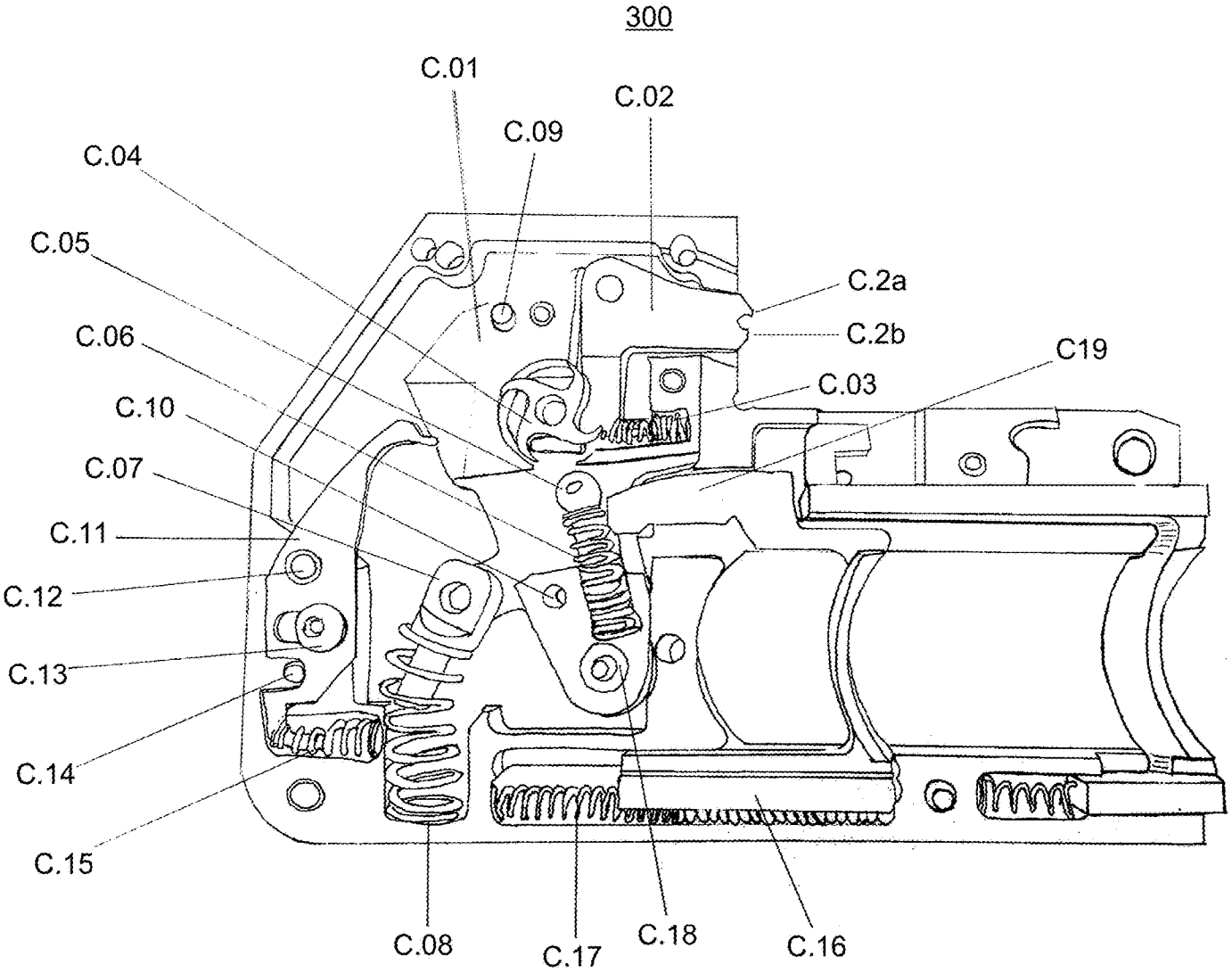
FIG. 3 provides a illustration according to at least one embodiment of the related invention of an open view of the left side Hammer Set and internal assemblies contained therein FIG. 4 provides a illustration according to at least one embodiment of the related invention of an open view of Hammer Set Frames.

Referring now to FIG. 3 shows 300 an open view of the left side Hammer Set and internal assemblies contained therein according to at least one embodiment of the related invention. Table 3 sets forth reference designators corresponding to elements and components, whether separately provided or integrally formed into the left half the frame:

TABLE 3

Components and Elements of Left Side Hammerset and Internal Assemblies Therein

| Reference Designator | Component or Element |
|---|---|
| C.01 | Hammerset |
| C.02 | Firing Pin |
| C.03 | Firing Pin Spring |
| C.04 | Ratchet |
| C.05 | Ball Sear |
| C.06 | Ball Sear Spring |
| C.07 | Hammerset Spring Pivot |
| C.08 | Hammerset Main Spring |
| C.09 | Hammerset Alignment Pin |
| C.10 | Hammerset Attachment Holes |
| C.11 | Pawl |
| C.12 | Pawl Pivot Boss |
| C.13 | Pawl Attachment Screw |
| C.14 | Pawl Limit Pin |
| C.15 | Pawl Return Spring |
| C.16 | Firing Trigger |
| C.17 | Firing Trigger Spring |
| C.2a | Upper Barrel Striker |
| C.2b | Lower Barrel Striker |
| C.18 | Hammerset Pivot Boss |

Figure 4:
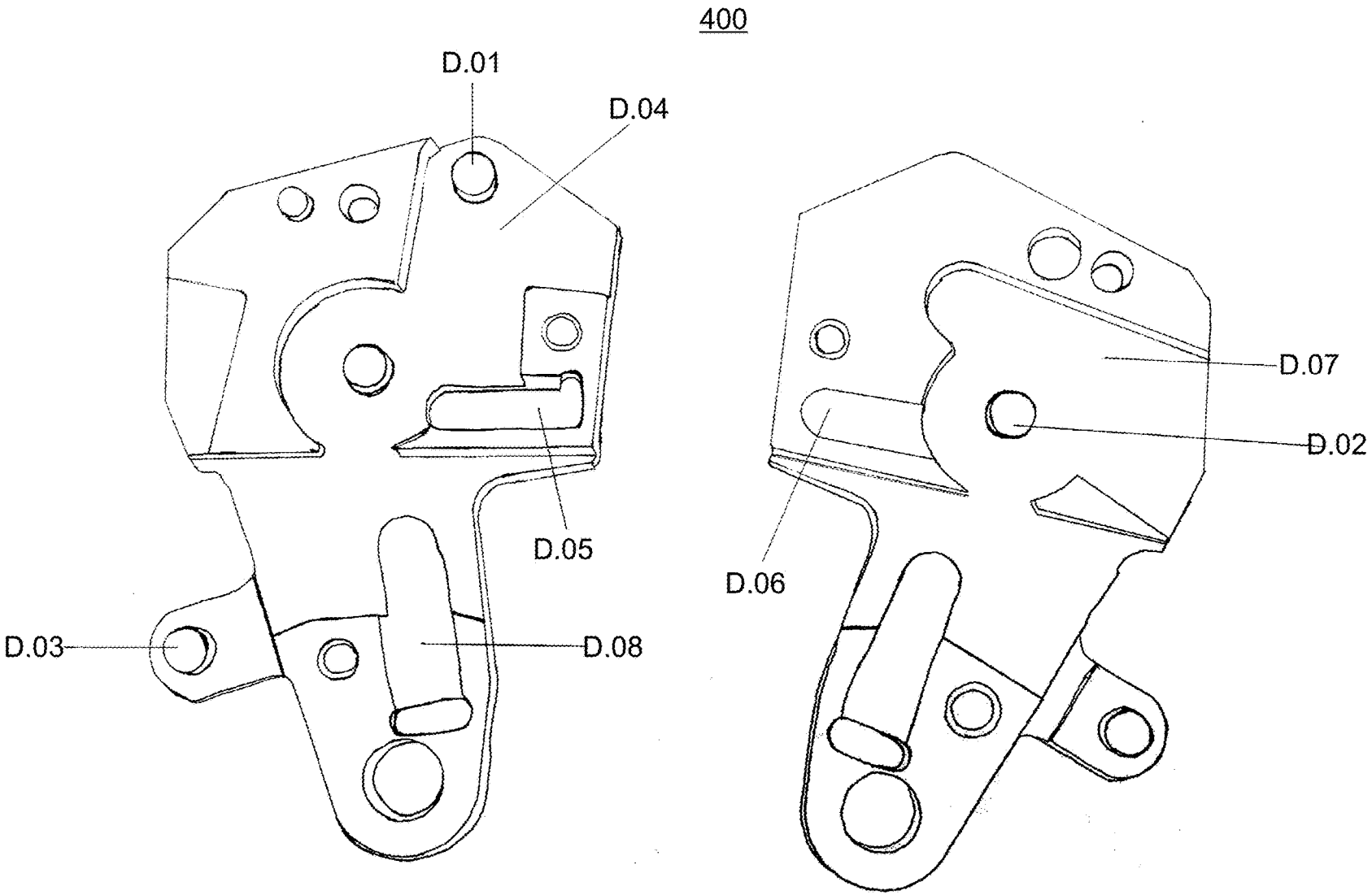

Referring now to FIG. 4 shows 400 an open view of Hammer Set Frames according to at least one embodiment of the related invention. Table 4 sets forth reference designators corresponding to elements and components, whether separately provided or integrally formed into the left half the frame:

TABLE 4

| Hammer Set Frames | |
|---|---|
| Reference Designator | Component or Element |
| D.01 | Firing Pin Pivot Boss |
| D.02 | Ratchet Pivot Boss |
| D.03 | Spring Pivot Boss |
| D.04 | Indexing Engagement Relief |
| D.05 | Firing Pin Spring Cavity |
| D.06 | Firing Pin Spring Relief |
| D.07 | Pawl Relief Clearance |
| D.08 | Ball Track |

Figure 5:
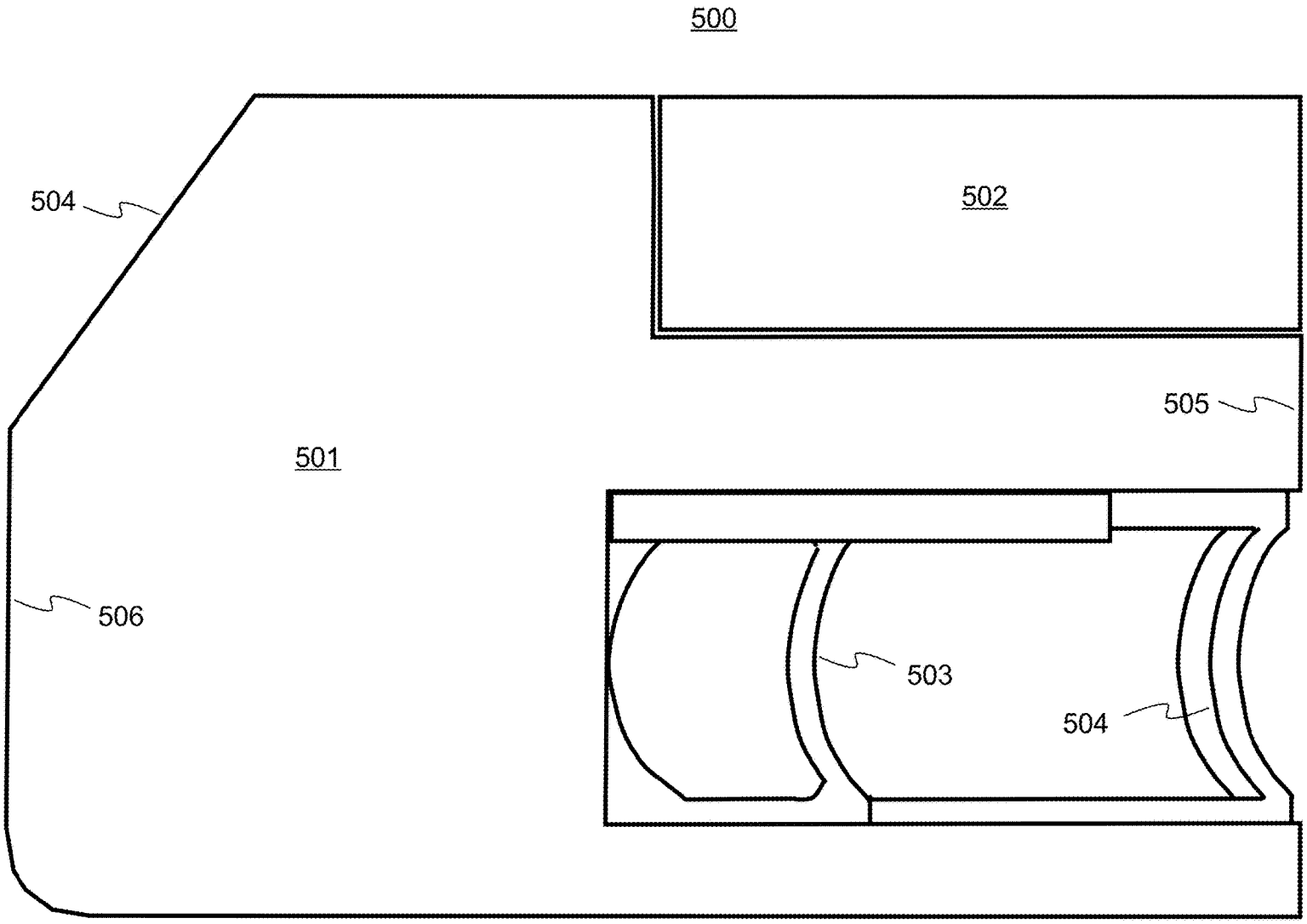
FIG. 5 illustrates an outside view of an assembled pistol according to at least one embodiment of the related invention "in battery" configuration.

Turning now to FIG. 5, an outside view 500 from the right side of the pistol is shown in its assembled condition, thus hiding the internal components as shown in FIGS. 1-4, except for the barrel release trigger 504 and the firing trigger 503, both of which are biased by springs towards the front 505 of the firearm and are slidably operated towards the rear 506 of the firearm. The two barrels 502 are shown in this embodiment in an over-and-under configuration in a latched down ("in battery") condition. The larger area 501 of the side panel serves partially as a grip, and the angled edge 504 serves as a form of a tang, as will be seen in subsequent drawings.

Figure 6:
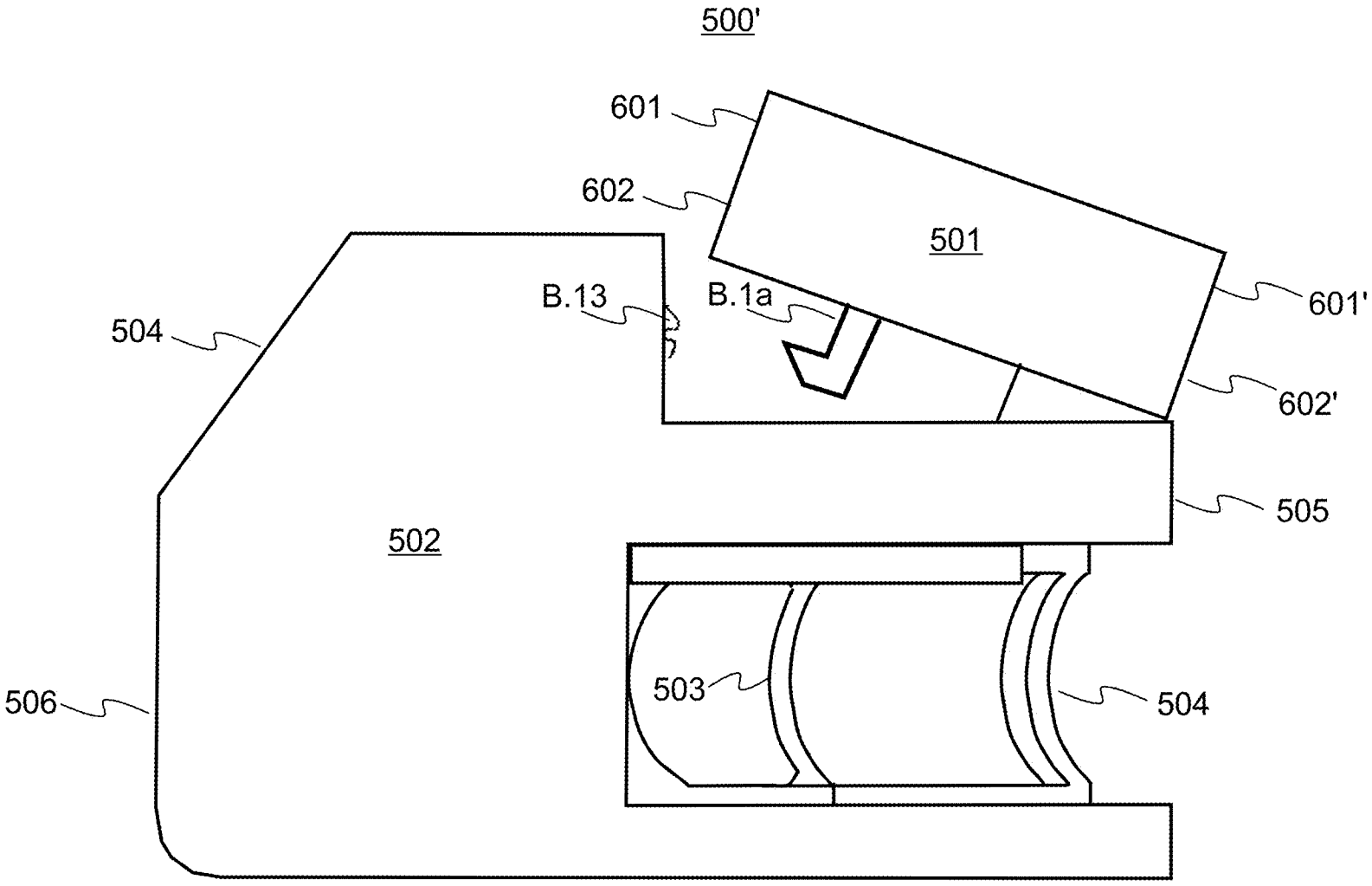
FIG. 6 illustrates an outside view of an assembled pistol according to at least one embodiment of the related invention "out-of-battery" configuration for loading and unloading cartridges.

Referring to FIG. 6, the same view of FIG. 5 is presented, however, the barrel release trigger 504 has been operated by sliding it towards the rear 506 of the pistol, thereby causing the internal components to release the barrels 501 to allow them to be tilted upward into a loading and unloading configuration 500'. In this out-of-battery configuration, the two chambers 601 and 602, which are linearly aligned through the bores of the barrels (hidden from view) with the two corresponding muzzles 601' and 602', can be accessed to load fresh (unspent) cartridges or unload (spent) cartridges from the pistol.

Figure 7:
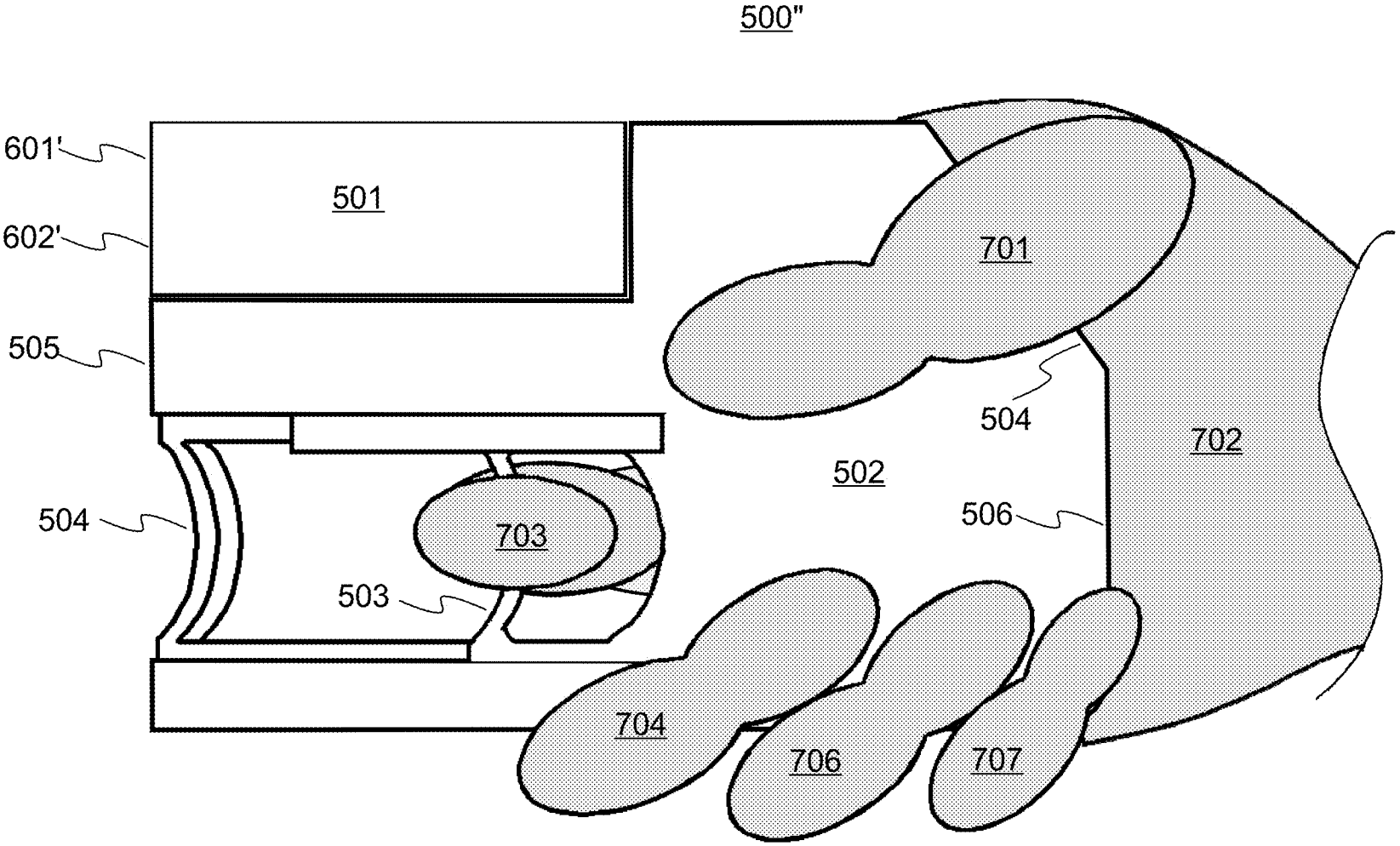
FIG. 7 shows a simulated manner of use by a holder of a pistol according to at least one embodiment of the related invention.

Referring to FIG. 7, a configuration of the pistol as being held 500" by a user is shown, in which the user's hand is shown in gray. The rear edge 506 is received into the palm 702 of the user, and the tang portion 504 receives the user's thumb 701 folded over it. The user's middle, ring, and little (pinky) fingers 704, 706 and 707 are wrapped around the bottom edge of the pistol, thereby securing it into the user's hand and allowing for the firing trigger 703 and barrel release trigger 504 to be selectively operated by the user's first or pointing finger 703.

Returning to FIG. 1, the internal details of the pistol frames both left and right may be viewed. The viewer may notice that each frame is of Monobloc construction. Manufacturing the frames in halves, presents a dual cavity mono bloc concept. The resultant design renders a set of pistol frames with almost all features for fastening, limiting, pivoting, aligning and spring bias to be integral in the frames construction. Viewing the Frames open face, without internal components, as in FIG. 1, all internal features may be viewed. The reader will first see cut-away section A.01 for barrel set placement and provision for barrel set attachment screw at muzzle end A02. The reader will then notice the main frame cavity at A.03 to house the pistol's hammer set. The reader will then see means for Hammer Set rotation in integral boss projections at A.04. The reader may then notice the adjoining slot at A.05 to contain and align the Hammer Set mainspring.

The reader may then observe the linear raceway slots at A.06 to provide guiding means for both firing and barrel release triggers. Accompanying slots to house both triggers' springs may be found at A.07. The reader may then turn to view relief surface for Barrel pivot at A.08. The reader will observe internal ledge at A.09 to serve as limiting surface for barrel set in open position. The reader may then recognize relief cavity for barrel set lockup engagements at A.10. The integral boss at A.11 serves to limit the travel of the barrel release trigger.

The reader may then turn to the slot at A.12 to notice provision for pawl spring containment. Accompanying pawl features at A.13, A.14, and A.15 bring service to limiting pin, attachment hole, and pivot bushing, respectively. Lastly the reader may notice the frame-to-frame attachment holes at A.16, accompanying alignment pin holes at A.17, and pawl relief at A.18.

Returning to FIG. 2, the pistol may be seen in semi-assembled view. The reader may notice the hinged Barrel Set at B.01 to be an over and under configuration that pivots at terminal muzzle end. The reader may then observe the threaded hinge bolt at B.07 for securing the barrel to the frames and notice the previously encapsulated spring at B.08 to provide for barrel tilt. The barrel trigger B.02 may be viewed, and the reader may notice latch locking surfaces at B.2*a* and B.1*a*. Further observation would reveal that as the barrel latch surfaces make contact to lock, the angular latch on the barrel set drives the barrel trigger latch rearward to contact the firing trigger blade pushing it back slightly into the Hammer set subsequently pushing the firing pin back to allow for an unobstructed lock up. Barrel trigger actuation spring may be viewed at B.03.

In FIG. 2, the extractor B.04 for the Barrel set may be observed. The extractor is lineally guided in extractor T-slot referenced at B.1*b*, held in place by set screw at B.05, with extractor spring at B.06 to provide spring bias. The general relationship of the primary firing components can be viewed where Firing Trigger at B.09 engages internally with Hammer Set at B.10, as Pawl at B.12 provides for ratchet index with protected internal engagement from the rear.

Returning to FIG. 3, the Hammer Set arrangement may be viewed as exposed. Left side Hammer Set frame may be viewed at C.01. C.02 represents the firing Pin with firing pin index spring at C.03 to provide bias. The reader will notice independent striker surfaces at C.2*a* and C.2*b* for the top and bottom cartridges, respectively. The Ratchet to actuate barrel selection may be seen at C.04. When engaged by the Pawl at C.11, during Hammer Set rotation, the ratchet indexes about its center to present two alternating surface engagements to the Firing Pin. These engagement surfaces serve to change the angularity of the Firing Pin using reciprocating motion, aligning each Striker surface to its respective cartridge with successive pulls of the trigger. Pawl attachment screw can be viewed at C.13, pivot bushing at C.12 and limiting pin at C.14. Pawl return spring may be viewed at C.15.

Firing Trigger C.16 and its engagement with the Hammer Set at C.01 is shown in FIG. 3. Depression of the trigger forces Firing Trigger Blade at C.19 into contact with previously encapsulated Hammer Set ball at C.05. Please note that Hammer Set Ball at C.05 is not shown in lowered position due to design constraints.

Continued depression acts to start Hammer Set rotation centered on Hammer Set Pivot Boss at C.18 and begin compression of Hammer Set ball C.05 and Ball Spring at C.06. Simultaneously, Spring Pivot at C.07 and Hammer Set Main Spring at C.08 also begin to compress.

Please note also that Spring Pivot at C.07 in this example embodiment is represented as a rotating link which also serves to pilot in the spring. This embodiment has since proven to produce undesirable drag and has been changed to a ball engagement for main spring compression. The new embodiment provides multidirectional compression of spring bias, as well as assists in generating a focused and free transmission of energy release.

Further depression adds the contact of engagement surfaces of the Pawl at C.11 and Ratchet at C.04. Complete Firing Trigger depression brings Hammer Set Ball and Firing Trigger Blade to terminal arc end of rotation with simultaneous completion of Ratchet index rotation at C.04. Hammer Set release is achieved as Hammer Set Ball descends beneath the Firing Trigger Blade at terminal arc end releasing compressed Hammer Set Main Spring at C.08, allowing rotation and subsequent pistol firing. Firing Trigger reset is provided for via Firing Trigger Spring at C.17.

Returning now to FIG. 4, the reader will view the Hammer Set frames in open, empty condition. The reader will notice the Hammer Set Frames to also be of dual cavity mono bloc construction. The integral pivot boss at D.01 serves to position the Firing Pin and also as a hinge point. The integral Pivot Boss at D.02 to locate and provide for Ratchet rotation. The integral pivot boss at D.03 provides for Spring Pilot anchor and rotation.

Please note that the integral pivot boss at D.03 has been removed and changed to a spherical pocket to captivate said ball for improved embodiment at spring engagement C.07.

Indexing engagement relief may be viewed at D.04 with adjoining spring pocket at D.05. D.06 represents spring relief as D.07 provides clearance relief for the Pawl. D.08 represents both the pocket for the ball spring and the track for the Hammer sets' ball. D.09 is clearance relief for the firing trigger blade.

As such, the detailed and described embodiment of the foregoing paragraphs discloses a pocket pistol design with an over under barrel configuration, using two triggers: a fore-mounted trigger which actuates barrel release (but which does not fire a round), and a rear mounted trigger which fires the cartridges (one pull per round fired). Both Pistol Frame halves and the Hammer Set are of dual cavity Monobloc construction. The Pistol is Double Action. The Pistol incorporates an enclosed, radially configured, ratchet to provide for the action of barrel selection. The presented embodiment employs a Ball and Blade Sear for the action of Cocking and firing.

The present invention provides one or more unique features, functions and elements not incorporated in other pocket pistol designs, which when embodied individually or in combination, meet several previously-unmet needs in the art. The first design element that may be viewed as unique to the art is the use of two independent triggers: the fore-mounted trigger for barrel release and the rear mounted trigger for pistol firing. The fore-mounted trigger that provides for barrel release is different from other multi-barrel pistol designs in that most existing designs incorporate a thumb latch to actuate barrel release for reloading. While both designs allow for single hand actuation, the thumb latch design inherently causes a momentary loss of grip while reloading takes place. Our fore-mounted trigger design allows for the thumb to remain in hold position and subsequent gripping force to be maintained while barrel release is actuated and reloading takes place.

Second, some embodiments according to the related invention eliminate the thumb latch buttons or levers contained in existing designs which often protrude from the pistol's frame, and which create potential hang points that can hinder the user from drawing quick action. This aspect is often twice as evident when ambidextrous controls are present on some models of pocket pistols. Some embodiments of the related invention may produce no projections from the sides of the frame to avoid potential hang points as well as being ambidextrous in a single control.

Third, some embodiments of the related invention may incorporate our firing pin arrangement and design. Known firing pin designs employed in existing multi-barreled derringer type pistols have traditionally involved two types of striker pin designs. In four barrel designs, as well as two barrel designs, a hammer operating as a secondary unit indexes to make targeted contact with firing pins aligned independently with each barrel. This design is represented as one hammer, multiple striker pins. The other traditional approach has the striker itself to change position in relation to the cartridge. This second traditional design is one hammer, one pin. However, according to at least one embodiment of the related invention, our firing pin arrangement and design presents a striker with two independent contact surfaces to engage the cartridges. The design is one hammer, one pin, but with two engaging surfaces. As such, the related invention allows for the simplicity of the one hammer one pin design, while changing the wear characteristics by distributing the strikes between two different surfaces. This introduced redundancy also increases both reliability and longevity.

Fourth, embodiments according to the related invention may incorporate the present invention's firing trigger arrangement and design. The inventors believe that this pocket pistol invention is the first of its kind to employ a captive ball and blade sear engagement to actuate firing of the pistol. Those skilled in the art understand that two basic types of finger piece trigger embodiments have evolved for use in firearms. The first is the hinged finger piece, allowing for rotation to actuate the firing mechanism. The second embodiment being a linear sliding type finger piece guided in slots or on rails, to provide for linear actuation of the firing mechanism.

According to at least one embodiment of the related invention, the new pocket pistol is the first of its kind to employ a lineally actuated finger piece without the use of levers to provide for sear engagement and related geometry. The captivated ball and blade arrangement allows for Bidirectional movement to allow for firing and subsequent reset. The unique embodiment presented with the related invention employs linear firing trigger actuation, represented in the finger piece blade, to work against an angularly captivated ball containing bias. As linear travel of the blade progressively drives the captivated ball and Hammer Set to rotation about their shared hinge point, ball compression is then seen to take place, and as rotation continues, the idea of terminal arc end becomes apparent. As ball track length and firing trigger blade configuration determine the terminal arc end point, the angularity of an over center track arrangement serves to enhance actuation.

The novelty of the Ball and Blade sear engagement according to at least one embodiment of the present invention is accentuated if not defined by the dual-cavity mono bloc construction principles applied in our Hammer Set design. The present inventors believe our Hammer Set design is the first of its kind to employ dual cavity mono bloc construction principles to all engagements contained within. This aspect simplifies both construction and manufacture by creating a Hammer Set design in which location and hinge pins are integral to frames. In addition, the symmetrical halves of our Hammer Set, present dual-cavity mono bloc construction principles as opposed to single cavity mono bloc principles, a considerable advancement over traditional designs. The inherent symmetry of our dual cavity mono bloc construction allows for relationships between actuating members to be centered about one another both radially and axially. Specific embodiments in this instance can be viewed in the relationships between our Pawl, Ratchet, and Firing Pin. The design yields a condition in which the ratchet and pawl action is centered with the cocking action, improving form and function. In addition, all three actions—pawl to ratchet, ratchet to firing pin, and blade to ball—are enclosed, each being protected during respective operation. This design aspect further increases reliability.

Fifth, the dual cavity mono bloc construction according to at least one embodiment of the present invention also allows for location and containment of both symmetrical and non-symmetrical operating elements. Specifically in this instance, our dual cavity design provides for the symmetrical location and containment of the ball and spring bias provision represented in the ball track, as well as the ball engagement for main spring compression represented in the required spherical pocket for the aforementioned improved main spring embodiment. Dual cavity mono bloc construction also provides for non-symmetrical operating elements represented in the location and containment of the firing pin and its spring.

ADDITIONAL EMBODIMENTS

Additional embodiments according to the present invention include, but are not limited to, making some features integral to the pistol frame instead of the hammer set frame, optionally with a combination of dual cavity construction using the exterior surfaces of the hammer set and the interior surfaces of the frame cavity or a combination thereof.

The ball and blade sear design of the present invention may be embodied in a reverse geometric arrangement employing counter-rotation, or rendered in an axial configuration employing a horizontal blade instead of a vertical blade as disclosed in the foregoing embodiment. The number of balls may be increased, and/or additional spherical elements added and and/or the angularity of such features changed to create a similar bi-directional condition of terminal arc end. The ball and blade sear design of the present invention may also be realized with a rotating finger piece for actuation.

The firing pin design of the present invention may be realized in a side-by-side barrel configuration. In addition, embodiments of the present invention may be configured for centerfire cartridge use. Further, embodiments of the present invention may be adapted to employ an independent multiple striker design as well.

The dual trigger design according to the present invention may be realized using a rotating finger piece to actuate barrel release for spent shell ejection and/or loading, as has been achieved in certain shotgun embodiments. It may also be realized to actuate in a parallel arrangement, or, in addition, not represented as a trigger, but a forward barrel release feature accessible by the user's trigger finger that does not stand off from the frame to create a potential hang point.

New Trigger Mechanism

As mentioned in the foregoing paragraphs and shown in some detail in the drawings, some embodiments of the related pistol invention will include a new, thinner and flatter trigger mechanism. The present patent application is directed towards this new trigger mechanism and its various embodiments. The new Ball and Blade Trigger operates as a novel, single quadrant, fixed point, Scotch Yoke type of mechanism, which is the first known usage of a Scotch Yoke art to a firearm trigger.

Many different general-purpose mechanism are known to those ordinarily skilled in the art to convert or transmit rotary motion to linear motion and vice versa. Three primary examples are (1) the Geneva-type Movement, (2) the Slider Crank, and (3) a Scotch Yoke. Most early examples of these devices and the multitudes of descendants have been designed with the intention of constant power transmission, such as from a rotating motor (source of energy and power) to a reciprocating workpiece (output of power) such as a stamp or blade. Some of these mechanical devices have been used in the capacity of open loop actuation, albeit not in a capacity as a firearm trigger, such as the present invention.

Conventional Scotch Yoke designs employ a double acting vertical Yoke Slider Head to provide reciprocation across the face of the axial drive crank. The sliding element moves 360 degrees about the crank's center, thus employing all 4 radial quadrants, as defined 800 in FIG. 8. Fixed point versions of Scotch Yoke mechanisms position the crank to operate around a fixed link. These versions are designed for use in either two or four radial quadrants. The universal element in both designs is the relationship between motion and the geometric principle of sine/cosine change. The principle is most apparent as seen in the actual sine/cosine quadrant change of closed loop constant motion examples. It could be stated that the defining characteristic of traditional constant motion designs would be sine/cosine quadrant change to effect rotation/reciprocation.

Embodiments of the new Ball and Blade trigger of the present invention take advantage of the principle of sine/cosine change in the conversion of linear motion to radial motion, as well, in order to provide the flatter and thinner improvements over conventional triggers and in order to support the linear movement of the triggers of pistols such as the example provided in the related invention.

The new trigger mechanism, however, preferrably operates in a single quadrant, and is designed for open loop actuation, such that some conventional Scotch Yoke movement and construction restraints do not apply. One particular restraint would relate to the Crank and Yoke members always existing as independent components. The relationship interpreted as one power input and one power output as represented in constant motion examples. An additional example would be that the drive element is almost always rigidly affixed to the crank member, again to support rigid radial drive and quadrant change in constant motion designs. Yet another constraint in constant motion designs would be that the Yoke most often exists as one slider link containing both Drive and Control surfaces for actuation.

As such, embodiment of the Ball and Blade trigger of the present invention serve as departures from conventional firearms trigger design and, to a degree, a departure from the full constraints of a conventional Scotch Yoke mechanism.

Embodiments of our new trigger mechanism employ a single-quadrant modified Scotch Yoke actuation, such as operation only in Quadrant 1 800. Embodiments of our new Ball and Blade design incorporate linear actuation of the trigger blade as guided, independent, input force, working against the Ball, held as a captive sliding element under spring bias in the Integral Spherical Yoke contained in the spring biased Crank represented as the Hammer Set. The Hammer Set is therefore positioned to rotate around a fixed link contained in the Pistol Frame. Trigger mechanism output occurs as the sliding element (Ball) reaches the terminal point in its respective arc and sine/cosine position, which is followed by a directional change in movement. Linear Output becomes apparent during reset as ball return path is 0 degrees to rotation.

The modified Scotch Yoke-like mechanism devised by the present inventors employs a unique system in which the elements of Crank, Yoke, and Drive Ball, are all contained within the same operating element, which we refer to as the Hammer Set. The finger piece of the example embodiment shown in the foregoing figures uses stepped rails to provide linear affixation, bias, and movement guidance. The accompanying stepped slots machined in the symmetrical frame halves of the gun function as bearing block supports. The finger piece design allows for parallel linear guidance of the blade as its yoke control surfaces operate against the drive ball.

The Hammer Set system brings direct linear input of the Finger Piece Blade to engage the Ball as encapsulated drive element under spring bias. This linear progression initiates clockwise radial motion of the Hammer Set Crank. The drive Ball then follows the Yoke control surface of the Blade as the drive Ball and Hammer Set Crank are driven to rotation. The drive Ball under spring bias maintains fixed position throughout radial travel until the sine/cosine terminal endpoint is reached.

When the sine/cosine terminal endpoint is reached by the drive Ball, the corresponding Yoke Control Surfaces change from Vertical to Horizontal. The Yoke Control Surfaces changes allow the drive Ball to transition to the horizontal Yoke Surface as its spring bias is overcome. The Hammer Set Crank is now allowed to release its energy bias as the drive Ball is guided horizontally to reset during rotation.

The Finger Piece, once released from compression, allows the linear reset of trigger Blade and the corresponding Yoke Surfaces. The Ball element follows the Yoke Surfaces as the Finger Piece is released, culminating in the Ball returning to biased drive position.

Physical and mechanical novel features of embodiments of this new trigger mechanism serve to represent the actual control surfaces of the Yoke member in space. The Ball in the improved trigger mechanism serves as an encapsulated drive element, spring biased, in spherical yoke pockets. The symmetrical pockets, formed in each half of the Hammer Set, form one pocket inside the Hammer Set once assembled, which creates a closed track with spherical relief at the drive end.

The spherical track acts as the yoke drive surface allowing for the Ball to maintain positioned containment throughout drive and reset movement operations. The Yoke Control surfaces formed in relief on the trigger Blade element combined with the encapsulated Ball Drive element provide an open loop design. The trigger Blade, as a piloted yoke, the encapsulated Ball, and the spherical Yoke, once formed, arranged and assembled in their disclosed relationships may be applied with the accompanying spring bias, to the Hammer Set and the Frame formation, thereby allowing for fixed point, open loop, modified Scotch Yoke-like trigger actuation.

Functional and operational novel features of embodiments of this new trigger mechanism includes that it requires one hinged escapement. Those skilled in the art of firearm trigger design understand that the overwhelming majority of firearms trigger actuating systems operate with the finger piece affixed "rotatably" or "pivotably" to the frame." Many traditional firing systems operate with two or more rotary or hinged unions, with a first union originating at the finger piece, and a second union to control the sear. Many conventional firearms trigger mechanisms present the firing train initiation and actuation relationship to function as rotary to rotary motion relationship. Other conventional trigger systems operate with a rotary union at the finger piece to contain or engage lever geometry at the sear. The firing train relationship in many of these conventional triggers is rotary to rotary, as well.

However, embodiments of the present trigger invention provide straight linear travel at the Finger Piece, not rotating trigger travel. The Finger Piece is linearly affixed to the frame via rails in at least one embodiment according to the present invention, and the Finger Piece itself has no rotary members directly affixed. The firing train of embodiments according to the present invention are represented as linear to rotary motion conversion or translation, accomplished through modified, single-quadrant open-loop Scotch Yoke-like trigger actuation. Yoke control surfaces contained in the finger piece blade engage the ball to employ the geometric principle contained in arc rotation and sine/cosine terminal end point to provide for actuation. The arrangement of elements of the embodiments of the present invention effectively creates a new, never before known Scotch Yoke type of sear engagement, characterized in this instance by the Ball and Blade remaining in constant contact throughout actuation of the trigger mechanism. A design characteristic consistent with drive and control elements in constant motion designs. In at least these ways, the present invention serves as a departure and improvement from conventional art of trigger design, replacing conventional firing train systems with a thinner, flatter mechanism.

Figure 8:
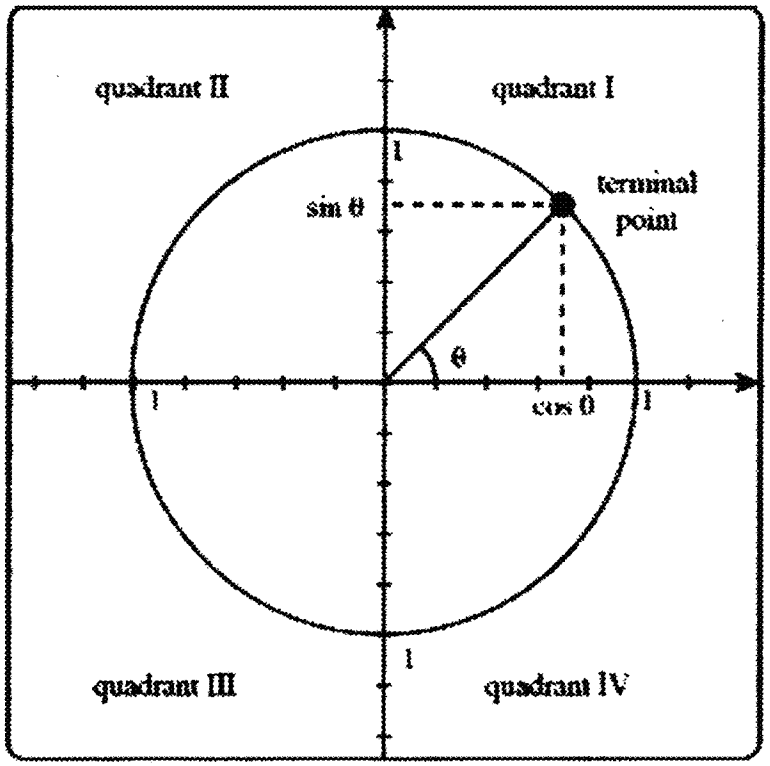
FIG. 8 provides a reference chart regarding quadrants of operation of rotary mechanisms and devices.
Figure 9:
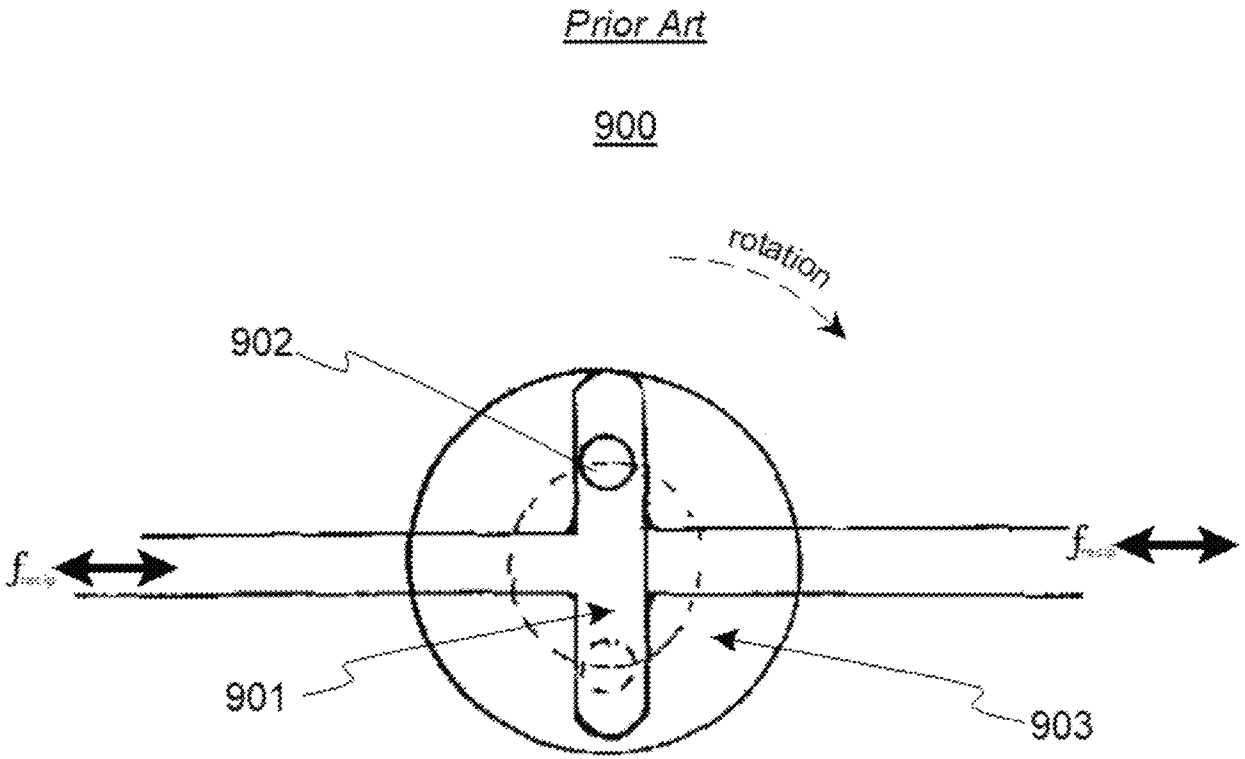
FIG. 9 illustrates a typical Scotch Yoke type of mechanism in which the drive pin operates in two axes.

Turning now to FIG. 8, a reference diagram 800 is provided for the mechanical operation of a Scotch Yoke-type of mechanism, as it is known in the arts. Referring to FIG. 9, a reference diagram 900 is shown for a double-acting axial crank drive in which the crank 903 is turned by a power source, and a drive pin 902 turns about a center (of the pin) within a yoke slot 901 which guides the drive pin 902 to produce linear reciprocating output motion and output force $f_{recip}$. Motion of the output of the Scotch Yoke-type of mechanism reverses direction when the terminal arc end of the drive pin movement is reached within a quadrant of operation. As such, with a standard Scotch Yoke mechanism, the drive pin will eventually move into all four quadrants during full operation.

Figure 10:
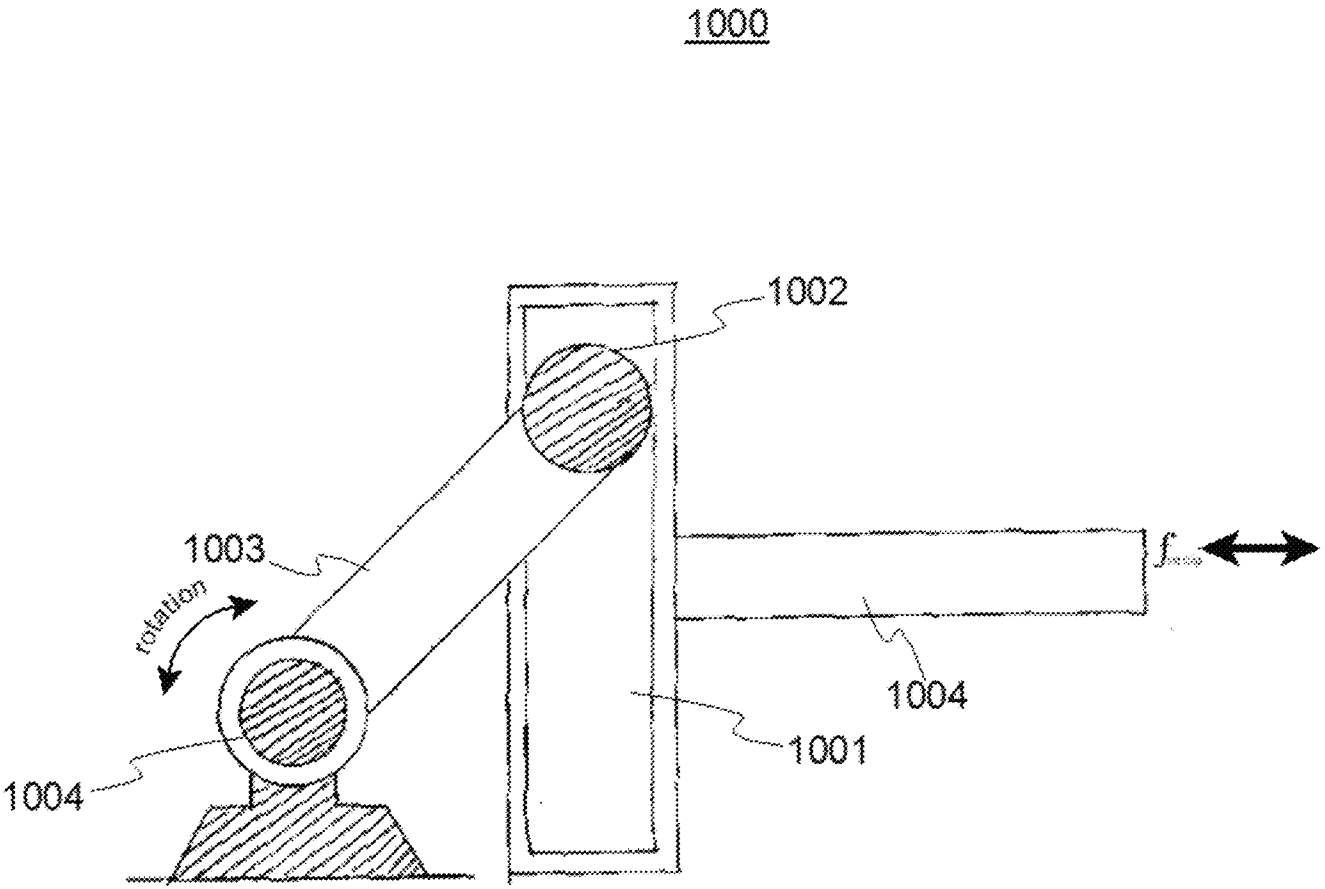
FIG. 10 provides an example of a typical Scotch Yoke type of mechanism which operates a drive pin in one axis.

Referring now to FIG. 10, an example 1000 of a fixed-link Scotch Yoke mechanism which brings linear motion and force $f_{recip}$ as an input power source to act against a sliding pin 1002 and driving crank 1003, in which the sliding pin 1002 is captured in a one-dimensional (vertical in this example) yoke slot 1001 to drive rotation and counter rotation as the output of the mechanism. Motion of the rotating output element changes direction when the terminal arc end is reached by the sliding pin in that quadrant of operation, thereby converting the input linear motion (and force or power) to output reciprocating output motion (and force and power).

Figure 11:
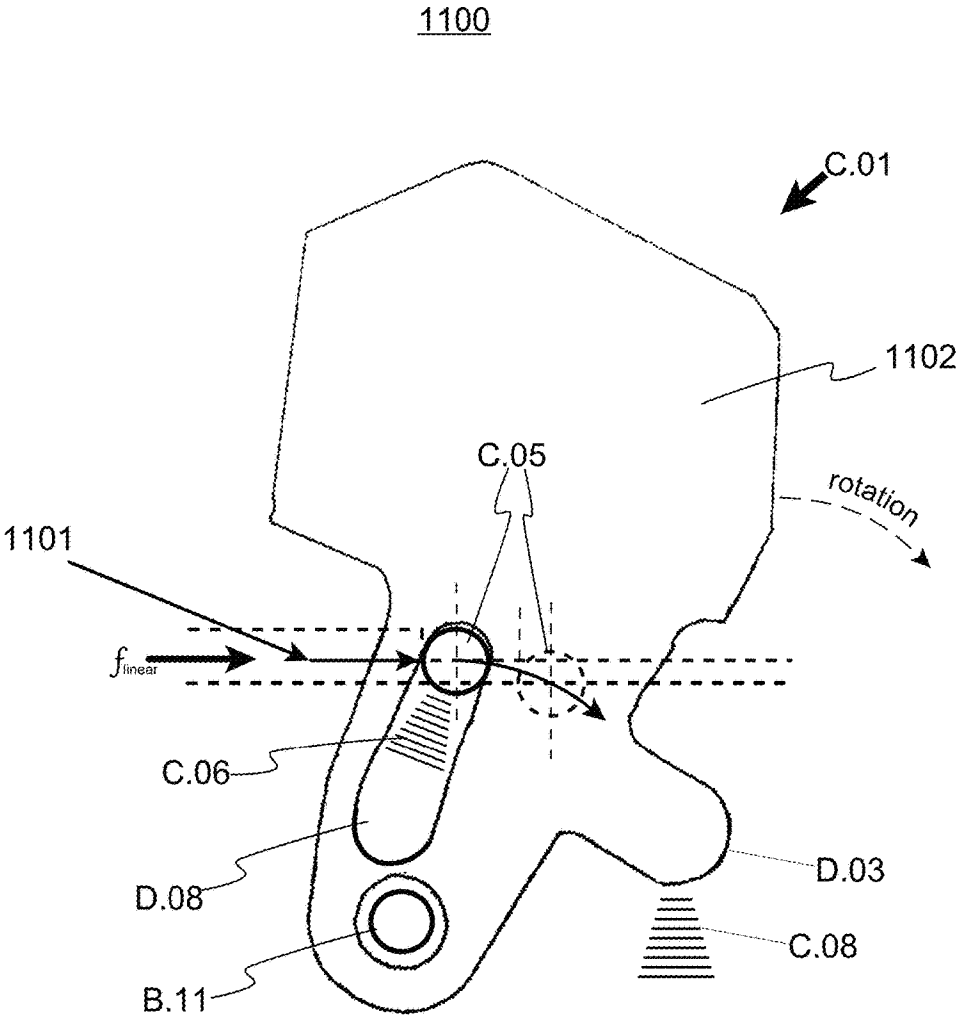
FIG. 11 shows an embodiment of a hammerset according to the present invention.

Turning to FIG. 11, more details of the new trigger mechanism 1100 are shown in which the blade 1101 is received as a power input of linear motion and force $f_{rinear}$ into a single-acting, flixed link Scotch Yoke type of mechanism. In this novel mechanism, the Ball C.05 acts as a captive Drive element with a spring bias C.06, and the Crank 1102 of C.01, Yoke D.08, and Drive elements are all contained within a single operating element which we refer to as the Hammerset C.01. The output of this trigger mechanism 1100 is the reset function of the spring biased Crank. Linear motion input actuates counterclockwise (in this example embodiment and from this particular side view)

radial motion output using the Scotch Yoke-like sine/cosine quadrant change in motion. In this example embodiment, both the Crank and the Drive elements employ springs for biasing.

A first benefit or advantage of this trigger mechanism is that no escapement is required because the trigger mechanism uses this sine/cosine change in motion. Another benefit or advantage of this trigger mechanism is that the blade is a sliding member, which eliminates any requirement for a typical hinged member in an ordinary trigger mechanism. Yet another benefit or advantage of this trigger mechanism is how constant power transmission from the blade movement through the crank and yoke provides for a smooth, continuous feel for the firearm trigger, unlike conventional hinged or rotating triggers in which the operator can feel different springs, resistance strengths, and discontinuities through the full motion of the trigger.

Figure 12:
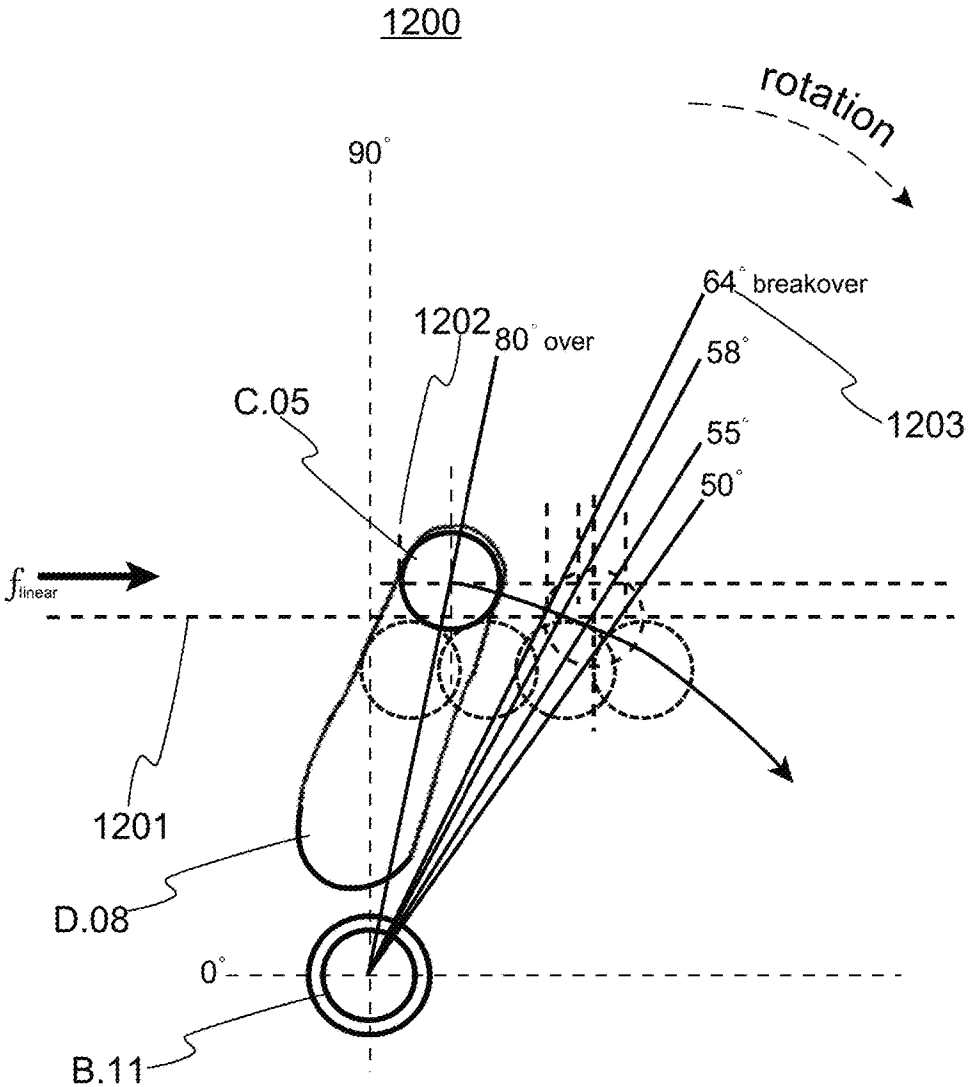
FIG. 12 details stepwise operation of the embodiment of FIG. 11.

FIG. 12 shows 1200 more details of the force and motion translations of the example embodiment of FIG. 11, in which reference of 0° is shown as horizontal, and 90° is shown as pointing straight up vertical. Yoke engagement is provided as two separate single-quadrant elements operating in the same quadrant, in this example embodiment. When the trigger is set, shown in this embodiment at the 80° position, the driving blade surface performs as a traditional vertical crosshead about the fixed link, and the driving crank and ball share the same rotation. The lower external blade surface performs similarly to how a two-slotted crosshead would perform in a constant motion design, albeit in a single quadrant, in this example embodiment. As the finger piece is operated and the blade provides the linear force $f_{linear}$ input to the trigger mechanism, moving the Ball clockwise through the angles of position as shown, during which a breakover position is reached, such as at 62°, and eventually a reset position at the end of the arc in the quadrant, followed by movement to reset the trigger for the next operation.

CONCLUSION

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The foregoing example embodiments do not define the extent or scope of the present invention, but instead are provided as illustrations of how to make and use at least one embodiment of the invention.

What is claimed is:

1. A hammerset device for a firearm comprising a Scotch Yoke mechanism disposed between a trigger finger piece and a rotationally-released firearm hammer wherein linear movement of the trigger finger piece is translated by the Scotch Yoke mechanism into rotational movement to release the firearm hammer.

2. The hammerset device as set forth in claim 1 wherein the Scotch Yoke mechanism is an open loop mechanism.

3. The hammerset device as set forth in claim 1 further comprising one or more guides for movement of the trigger finger piece, wherein the guides provide linear actuation of a trigger blade component compressed against a ball sear by a ball sear spring, and wherein the ball sear is held captive within the hammerset device.

4. The hammerset as set forth in claim 1 wherein a yoke component of the Scotch Yoke mechanism comprises a Spherical Yoke contained in a spring biased Crank.

5. The hammerset as set forth in claim 1 wherein the Scotch Yoke mechanism is integral to at least one half of the firearm frame.

6. The hammerset as set forth in claim 5 wherein the at least one half of a firearm frame comprises at least one half of a frame of a pocket pistol, wherein a total weight of the pocket pistol is less than or equal to 22 ounces, a length of the pocket pistol is less or equal to than 6.5 inches long, and a height of the pocket pistol is less than or equal to 5 inches high.

7. The hammerset of claim 6 wherein the pocket pistol frame comprises two monobloc halves.

8. The hammerset of claim 1 wherein the hammerset cooperates with a firing pin and the trigger during operation of the modified Scotch Yoke mechanism to provide double action operation to fire a single firearm cartridge per pull of the trigger, and resetting after each pull to fire another firearm cartridge on a subsequent pull.

9. A method of manufacture of a hammerset device for a firearm, comprising disposing a Scotch Yoke mechanism between a trigger finger piece and a rotationally-released firearm hammer wherein linear movement of the trigger finger piece is translated by the Scotch Yoke mechanism into rotational movement to release the firearm hammer.

10. The method as set forth in claim 9 wherein the disposing comprises disposing an open loop mechanism.

11. The method as set forth in claim 9 further comprising providing one or more guides for movement of the trigger finger piece, wherein the guides provide linear actuation of a trigger blade component compressed against a ball sear by a ball sear spring, and wherein the ball sear is held captive within the hammerset device.

12. The method as set forth in claim 9 wherein the disposing comprises disposing a yoke component of the Spherical Yoke contained in a spring biased Crank.

13. The method as set forth in claim 9 wherein the disposing comprises forming the Scotch Yoke mechanism integral to at least one half of a firearm frame.

14. The method as set forth in claim 13 wherein the at least one half of a firearm frame comprises at least one half of a frame of a pocket pistol, wherein a total weight of the pocket pistol is less than or equal to 22 ounces, a length of the pocket pistol is less or equal to than 6.5 inches long, and a height of the pocket pistol is less than or equal to 5 inches high.

15. The method as set forth in claim 14 wherein the pocket pistol frame comprises two monobloc halves.

16. The method as set forth in claim 9 wherein the hammerset cooperates with a firing pin and the trigger during operation of the modified Scotch Yoke mechanism to provide double action operation to fire a single firearm cartridge per pull of the trigger, and resetting after each pull to fire another firearm cartridge on a subsequent pull.

17. The hammerset of claim 1 wherein the Scotch Yoke mechanism comprises a mechanism with a fixed point pivot boss around which a firearm hammer pivots, and which operates in a single quadrant.

18. The method as set forth in claim 9 wherein the Scotch Yoke mechanism comprises a mechanism with a fixed point pivot boss around which a firearm hammer pivots, and which operates in a single quadrant.

* * * * *